US005630766A

United States Patent [19]

Granelli

[11] Patent Number: 5,630,766

[45] Date of Patent: May 20, 1997

[54] GOLF PUTTER

[75] Inventor: Dominic Granelli, San Francisco, Calif.

[73] Assignee: TJZ Enterprises, San Francisco, Calif.

[21] Appl. No.: 549,882

[22] Filed: Oct. 30, 1995

[51] Int. Cl.[6] ..... A63B 53/02; A63B 53/04

[52] U.S. Cl. ..... 473/313; 473/314; 473/325; 473/328; 473/340

[58] Field of Search ..... 473/313, 314, 473/325, 328, 340, 238, 252

[56] References Cited

U.S. PATENT DOCUMENTS

| | | | |
|---|---|---|---|
| D. 188,857 | 9/1960 | Mospan | D34/5 |
| D. 193,897 | 10/1962 | Vachon | 473/314 |
| D. 206,540 | 12/1966 | MacKenzie | 473/313 |
| D. 228,930 | 10/1973 | Leigh | D34/5 GC |
| D. 230,750 | 3/1974 | Ehrich | D34/5 GC |
| D. 271,604 | 11/1983 | Stone et al. | D21/217 |
| 1,250,296 | 12/1917 | Fitzjohn et al. . | |
| 1,334,189 | 3/1920 | Swanson | 473/314 |
| 2,478,468 | 8/1949 | Drake | 273/77 |
| 2,926,913 | 3/1960 | Stecher | 473/314 |
| 3,166,320 | 1/1965 | Onions | 473/314 |
| 3,448,981 | 6/1969 | Anweiler | 273/80 |
| 3,574,349 | 4/1971 | Kropp | 273/81 |
| 3,981,507 | 9/1976 | Nunziato | 473/340 |
| 5,267,733 | 12/1993 | Szokola | 273/167 |
| 5,344,149 | 9/1994 | Miller . | |
| 5,382,019 | 1/1995 | Sneed | 273/80 |

OTHER PUBLICATIONS

The United States Golf Association and The Royal and Ancient Golf Cub of St Andrews, Scotland, "The 1996 Rules of Golf and the Rules of Amateur Status," 1995.

"A Matter of Some Gravity," Ed Weathers, Golf Digest, Oct. 1995, pp. 78–80.

"Marketplace," Andrea Adelson, New York Times, Oct., 1995.

*Primary Examiner*—George J. Marlo

*Attorney, Agent, or Firm*—Dergosits & Noah LLP

[57] ABSTRACT

A golf putter has an elongated shaft, a neck, and a club head. The neck extends between the shaft and the club head. The club head has a striking face and a rear wall opposite the striking face, a top surface and a sole surface opposite the top surface. The top surface of the club head is oversized and in shape of a parallelogram. The breadth of the club head being at least 3.0 inches, preferably between 3.0 and 4.5 inches. The longitudinal axis of the shaft and the striking face of the club head is coplanar. In a preferred embodiment the shaft longitudinal axis is sub-perpendicular to the longitudinal axis of the striking face of the club head. In one embodiment the sole surface of the club head is sloped. In a preferred embodiment the sole surface has two cavities separated by a strut extending from the striking face of the club head to the rear wall.

14 Claims, 5 Drawing Sheets

GOLF PUTTER

FIELD OF THE INVENTION

The present invention relates generally to golf clubs, and more specifically, to a golf putter.

BACKGROUND OF THE INVENTION

The object of the game of golf is to place the ball into the cup at each hole using the least number of strokes to the ball. Thus, accuracy in striking the ball is of great importance. This is particularly true when the player is "putting" the ball into the cup at short distances from the cup.

Some important principles of putting are: (1) causing the putter to contact the ball at the correct angle, so that the golf ball travels in the direction intended by the golfer; (2) causing the ball to contact the putter at the center of the striking face ("the sweet spot"), so that the ball is struck at the center of gravity of the clubhead at the point of the most efficient impact; (3) using the proper shallow pendulum stroke; and (4) maintaining a comfortable stance with proper view of the ball.

A common error in putting occurs when the golfer incorrectly grips the putter handle and unintentionally rotates his hands about the longitudinal axis of the shaft causing the putter head to rotate away from its desired position. The rotation of the hand "opens" or "closes" the club face with respect to the ball such that the ball is "pushed" or "pulled" away from the direction in which the player is aiming the ball. Such an angular displacement deflects the ball away from the desired path by twice the angular displacement of the club head striking face. Thus, even small angles of displacement can have significant impact on the direction the ball will travel. Such angular displacements are one of the prime causes of missed putts that result in poor scores among golfers. Another common error in putting occurs when the golfer strikes the ball at the lateral portions of the striking face, instead of striking the ball at the center of the striking face. Additional problems arise when the golfer inadvertently contacts the surface of the putting green during the putting swing and thus fails to deliver a proper, even and shallow, pendulum stroke during the putt. When the golfer unintentionally hits the surface of the putting green in this manner, the club head is displaced resulting in a mis-hit.

In the past, golf putters have been designed with various markings or indicia to assist the golfer in aligning the center of mass of the club head with the center of the ball. Such putters, however, do little to help the golfer avoid "opening" or "closing" the club face. Such putters also do little to help the golfer avoid hitting the green during the shallow pendulum stroke.

The need arises to provide golfers with a golf putter which overcomes the above-described problems associated with putting that have not been solved by previously devised golf putters. It would be desirable to provide a golf putter with significant breadth such that even small angles of displacement of the club head are more readily detectable by the golfer. This way the player's tendency to open or close the striking face of the club head is minimized. It is also desirable to provide a golf putter which is designed to augment the ability of the golfer to accurately strike the ball at the "sweet spot." It is also desirable to provide a golf putter which enables a golfer to swing the putter in a arc directly perpendicular to a plane extending centrally though the golf ball and aligned with the intended path of movement of the golf ball without striking the ground.

SUMMARY OF THE INVENTION

According to the present invention, an improved golf putter is disclosed. One object of the invention is to provide an improved putter uniquely constructed so that a golfer may properly align the striking face directly perpendicular to the intended path of movement of the ball, minimizing the inadvertent angular displacement of the ball that occurs when the ball is hit at an angle (with a slightly "open" or "closed" face). This is accomplished by providing a substantially large and wide club head with a top view in the shape of a parallelogram. In this configuration the long, linear, and parallel toe end and heel end edges of the club head can be used by the player to align the putt. The club head should have significant breadth, at least 3.0 inches. The more significant the breadth, the longer the toe end and heel end edge of the club head, and the easier it is to align the club head squarely in the direction in which the ball is aimed. This configuration aids the golfer in determining whether the club head is positioned squarely in the direction in which the ball is being aimed. Even small angular displacements of the club head are readily detectable and visible with this oversized clubhead configuration.

A further object of this invention is to provide a putter which enables the player to accurately contact the ball at the center of the striking face ("the sweet spot") and to strike the ball squarely in the intended direction. In this invention the putter is constructed in such a manner to position the longitudinal axis of the shaft (extending from the grip of the shaft down to the club head end of the shaft), directly in line with the striking face of the putter and directly behind the golf ball properly addressed by the club. With this configuration, a player extending his arms forward and gripping the shaft need only to bend his body or head slightly for his eyes to be directly over and in the vertical plane of the grip, the shaft, the striking face, and the back surface of the ball. This puts the player in a position of optimum mechanical and ocular advantage It is still a further object of this invention to provide a golf putter with a sloped bottom or sole surface so as to minimizes a player's tendency to strike the ground during the proper shallow pendulum stroke used to putt golf balls into the cup. A putter with a sole surface that is narrower towards the rear wall opposite the striking face and wider at the striking face, enables the player to use the proper shallow pendulum stroke without striking the ground during the back swing and later upswing after contact with the golf ball. In a preferred embodiment, the sole surface contains parallel and substantially horizontal cavities and a center strut, so as to lighten the weight of the club head while maintaining the strength of the club head at its center of gravity.

In the preferred embodiment, the longitudinal axis of the shaft is sub-perpendicular to the longitudinal axis of the striking face of the club head.

Objects and advantages other than those set forth above will be apparent from the following description when read in conjunction with the accompanying drawings.

DETAILED DESCRIPTION OF THE INVENTION

Figure 1:
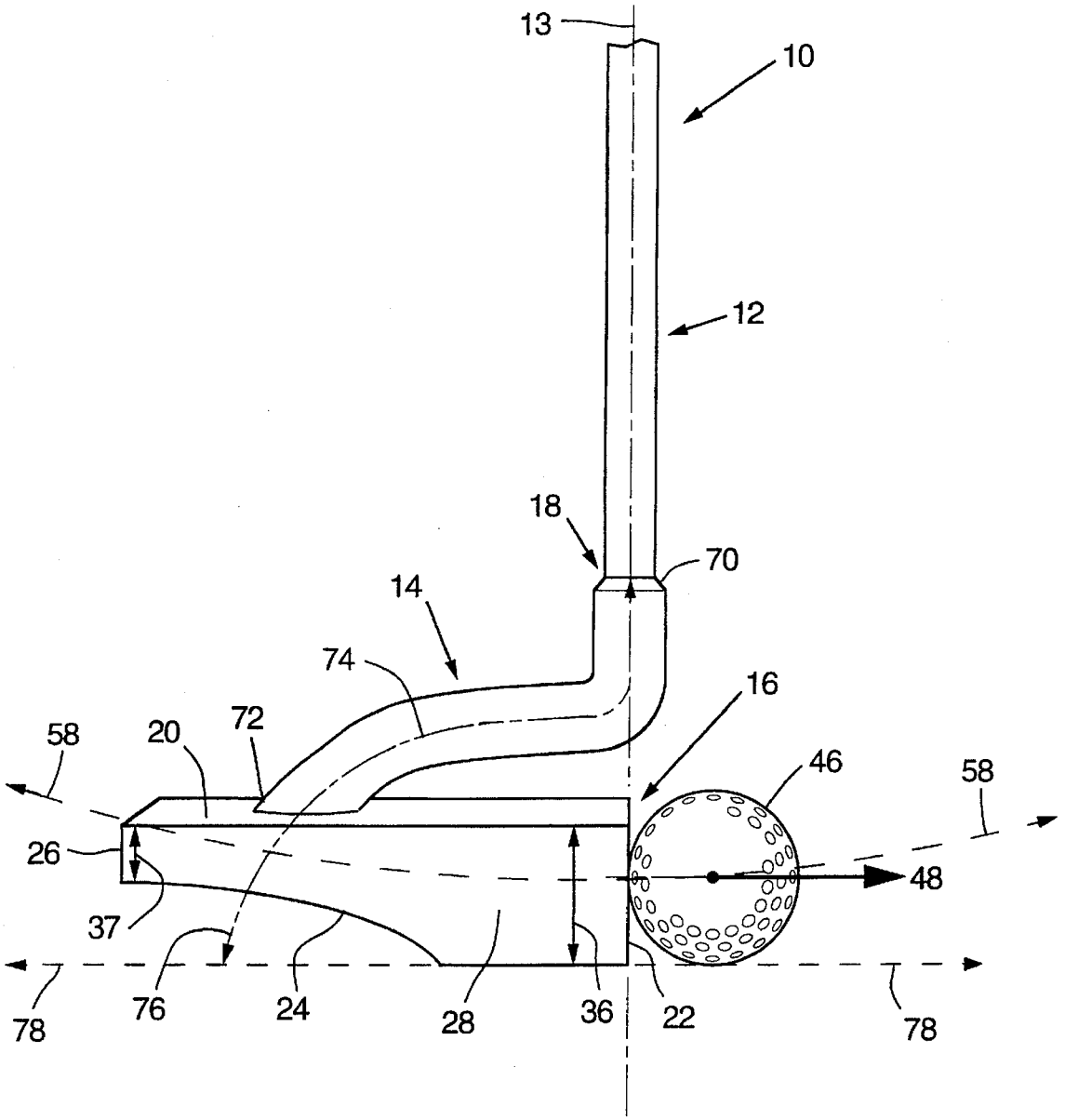
FIG. 1 shows the toe end view of the putter of the present invention.

Referring now to FIGS. 1–4. The golf putter 10 has a shaft 12, a neck 14, and a club head 16. The shaft 12 is only partially shown in FIG. 1. The portion not shown, the hand grip end of the shaft, is conventional and the selection of a handgrip is within the skill of those familiar with golf club design. In the preferred embodiment, the handgrip is 10½ inches long, tapered, and constructed from rubber. While a club for a right handed player is shown in FIGS. 1–4, it is understood that the present invention is equally adaptable to left handed clubs, and such a left-handed design is intended to fall within the scope of the claims below.

The shaft 12 extends from the hand grip end, not shown, to the club head end 18. The shaft 12 may be formed of any suitable material, such as steel, wood, graphite, composites and combinations thereof. The shaft 12 may be solid or hollow and may have a constant cross section along its length or it may be provided with a gradually decreasing diameter so as to provide tapering side walls from end to end. In a preferred embodiment, the shaft is constructed of aluminum, hollow, and tapered from the bottom of the shaft to the top of the shaft, such that the club head end 18 is narrower than the hand grip end (not shown). In the presently preferred embodiment, the length of the shaft is between 30 and 38 inches long; these various lengths of the shaft 12 are provided to accommodate players of varying heights.

The neck 14 extends between and is connected to the club head end 18 of the shaft 12 and the club head 16. The neck 14 may be formed of any suitable material, such as steel, wood, graphite, composites and combinations thereof. The neck can be either integrally formed as a continuous extension of the club head 16 or of the shaft 12 or the neck 14 can be a separate component wherein the upper end 70 of the neck 14 is connected to the club head end 18 of the shaft 12 and the lower end 72 of the shaft 14 is attached to the club head 16 by conventional means. The neck 14 may have any shape, such as the curved shape shown in FIG. 1. Alternately, the neck 14 may have a more generally straight sided or angular shape. In a presently preferred embodiment the neck 14 is constructed of '356 aluminum alloy, integrally formed as a continuous extension of the club head 16, and curved shape.

Figure 2A:
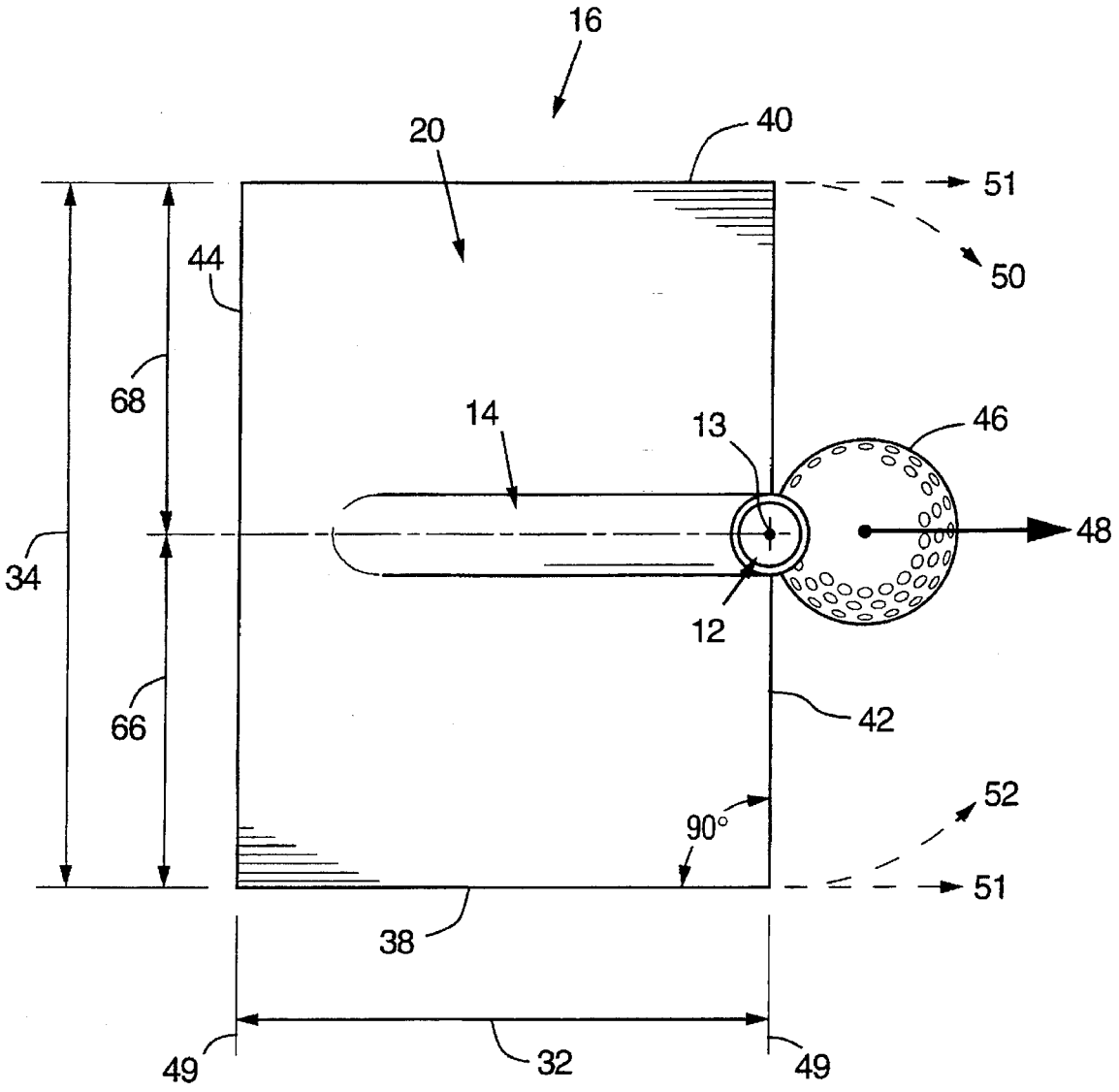
FIG. 2*a* is a top plan view of the club head, the neck, and shaft of the putter, when the neck is attached to the club head in a position equal in distance from the heel-end and toe-end edge.
Figure 2B:
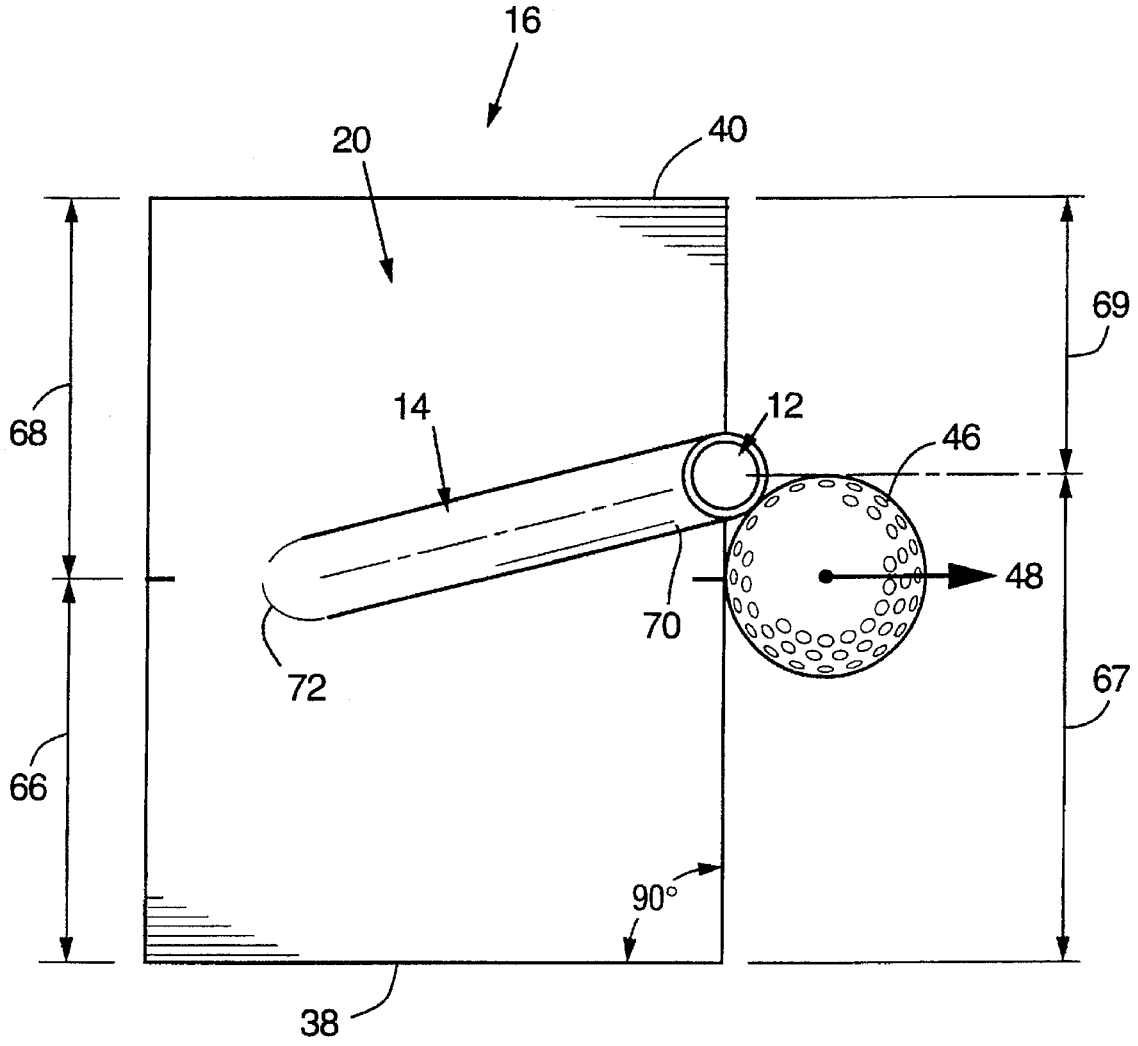
FIG. 2*b* is a top plan view of the club head and shaft where the neck is angular and the upper end of the neck is closer to the heel end edge of the club head.

The lower end 72 of the neck 14 may be connected to the club head 16 in various positions. In a preferred embodiment shown in FIGS. 2*a* and 2*b*, the position of attachment is on the top surface 20 of the club head 16 at a position equal in distance from the toe end edge 38 and the heel end edge 40 of the club head 16 such that distances 66 and 68 and shown in FIGS. 2*a* and 2*b* are equal. In the presently preferred embodiment shown in FIG. 2*b*, the neck 14 is angular such that the upper end 70 of the neck 14 is 0.5 inches closer to the heel end edge 40 than to the toe end edge 38 of the clubhead 16, such that distance 69 is 0.5 inches shorter than distance 67. In this position, the golfer can see the ball hit the "sweet spot" 56 (shown in FIG. 3) of the striking face 22 and the players view of the golf ball 46 is not blocked by the shaft 12 or the neck 14.

The club head 16 has a top surface 20, a sole surface 24 opposite the top surface 20, a striking face 22, a rear wall 26 opposite the striking face 22, a toe end 28 and heel end 30. The club head 16 may be formed of any suitable material, such as steel, wood, graphite, composites and combinations thereof. According to this invention, the top surface 20 of the club head 16 provides a substantially horizontal and planar surface in the shape of a parallelogram (see FIG. 2). The sole surface 24 of the club head 16 is opposite the top surface 20 (see FIG. 1) and although the sole surface 24 may be flat, in a preferred embodiment, the sole surface 24 is sloped as shown in FIG. 1. The striking face 22 extends between the top surface 20 and the sole surface 24 and forms a substantially vertical surface perpendicular to the top surface 20. The rear wall 26 extends from the top surface 20 to the sole surface 24 in a vertical plane opposite the striking face 22. The toe end 28 forms a substantially vertical plane between the top surface 20 and the sole surface 24. The heel end 30 also forms a substantially vertical plane between the top surface 20 to the sole surface 24. In this configuration, the toe end 28 is further from the player holding the club shaft for normal putting and the heel end 30 is closer to the player holding the shaft 12 for normal putting.

As shown in FIG. 2, the top surface 20 is in the shape of a parallelogram. In this configuration, the toe end edge 38 (formed by the intersection of the top surface 20 with the toe end 28 of the club head 16), and the heel end edge 40 (formed by the intersection of the top surface 20 with the heel end 30), are substantially parallel as seen in FIG. 2. Similarly, the striking face edge 42 (formed by the intersection of the top surface 20 with the striking face 22), and the rear wall edge 44 (formed by the intersection of the rear wall 26 with the top surface 20), are also substantially parallel as seen in FIG. 2. In the presently preferred embodiment, the striking face edge 42 and the toe end edge 38 define a 90 degree angle as shown in FIG. 2.

The breadth 32 of the top surface 20 (shown in FIG. 2) is at least 3.0 inches, preferably between 3.0 and 4.5 inches. The width 34 of the top surface 20 (shown in FIG. 2) is at least about 3.0 inches, preferably between 3.0 to 4.5 inches. The breadth 32 of the top surface 20 of the club head 16 should be less than or equal to the width 34 of the top surface 20 to satisfy the current United States Golf Association guidelines. In the presently preferred embodiment, the breadth 32 is 3⅞ inches and the width 34 is 4 inches.

During the proper shallow pendulum swing used in putting, the striking face edge 42 of the club head 16 should be directly perpendicular (see perpendicular position 49 in FIG. 2) to the desired path of movement 48 of the golf ball 46. When the striking face 22 strikes the ball 46 in this position the ball 46 will travel in the intended direction 48. As shown in FIG. 2, the putter that is the subject of this invention has been configured such that when the striking face edge 42 is in the proper position (directly perpendicular to the desired path of movement 48), the elongated and linear toe end edge 38 and the opposite heel end edge 40 of the club head 16 are substantially parallel to the desired path of movement 48 of the golf ball 46 (see position 51 in FIG. 2). This is because the toe end edge 38 and the striking face edge 42 of the club head 16 form a 90 degree angle. See FIG. 2. In the presently preferred embodiment, the striking face 22 and the toe-end 28 are milled so that a true 90° angle is formed.

A common error in putting occurs when the golfer inadvertently twists his/her hands clockwise and thereby opens (direction 50) the striking face edge 42 of the club head 16 with respect to the desired path of movement 48 of the ball 46 and mis-hits the ball 46. Another common error in putting occurs when the player inadvertently twists his or her hands counter clockwise and thereby closes (direction 52) the striking face edge 42 with respect to the intended path of movement 48 of the ball 46 and mis-hits the ball 46. The golf putter described in this invention provides a solution to these common mistakes. During the proper shallow pendulum swing, the golfer can use the substantially elongated and linear toe end edge 38 of the putter as a visual aid to line up the put. If the player inadvertently opens (direction 50) or closes (direction 52) the club head during the swing, the player can visually detect the mistake and make adjustments during the swing prior to striking the ball 46. In other words, once a player selects the desired path of movement 48 for the golf ball 46, the player is able to use the substantially elongated the toe end edge 38 of the club head 16 to correctly aim the golf ball 46 by keeping the toe-end edge 38 in a plane parallel to the desired path of movement 46 of the golf ball 46.

Figure 3:
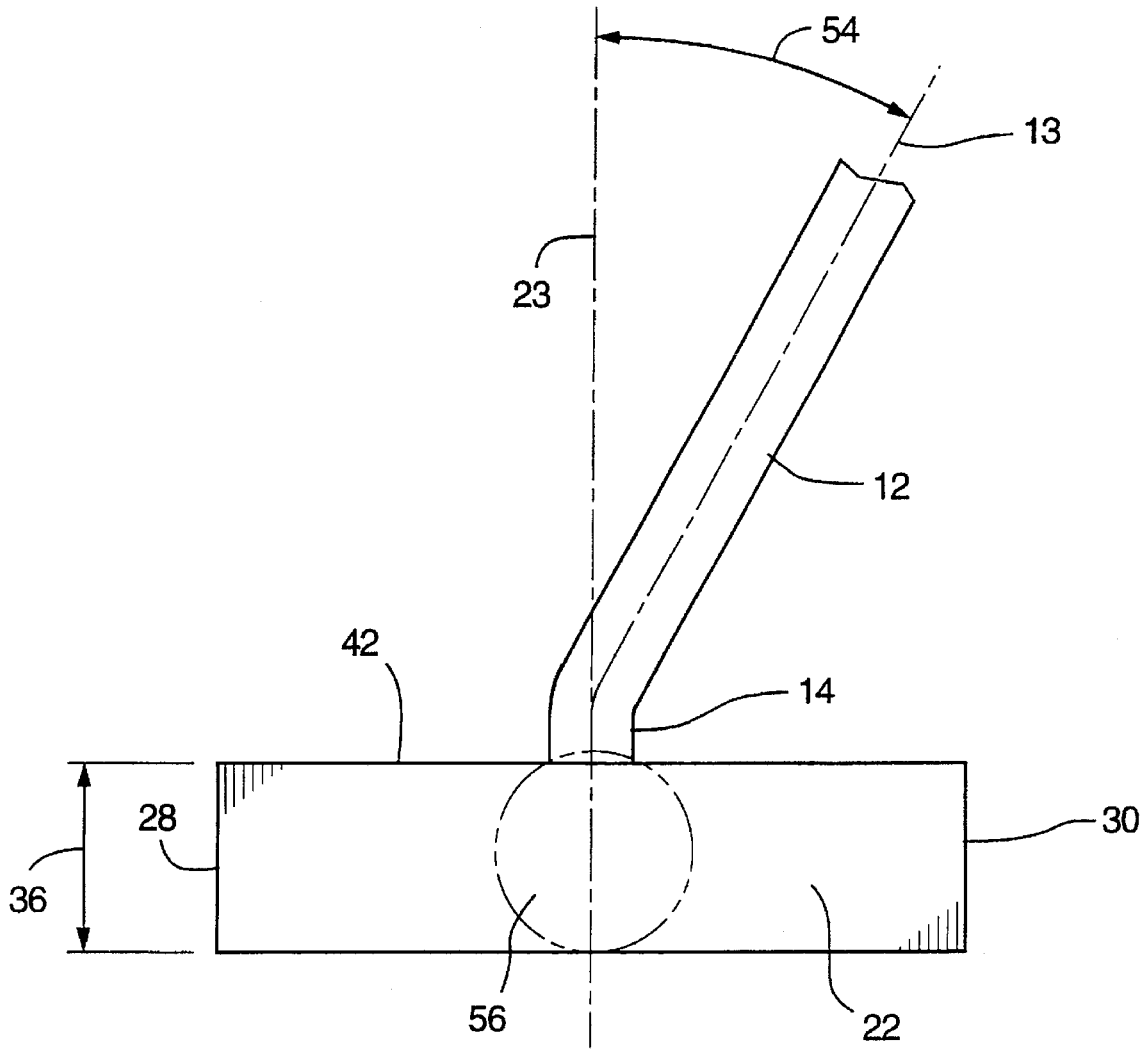
FIG. 3 is a front elevation view of the putter head and the shaft.

As shown in FIG. 1, the present invention also provides a golf putter 10 constructed in such a manner so as to position the longitudinal axis of the shaft 13, extending from the hand grip end of the shaft (not shown) to the club head end 18 of the shaft 12, in relation to the striking face 22 of the club head 16 and the ball 46 such that the longitudinal axis of the shaft 13 is directly in line with the striking face 22 and directly behind the golf ball. As shown in FIG. 3, in a preferred embodiment, the longitudinal axis of the shaft 13 is sub-perpendicular to the striking face edge 42 and sub-perpendicular to the longitudinal axis of the striking face 23. Preferably, the angular displacement 54 is 20 degrees. A putter so constructed, allows a player extending his arms forward and gripping the hand grip end of the shaft (not shown) to position his or her eyes directly over and in the same vertical plane of the shaft 12, the club face 22 and the back surface of the ball 46 where contact is made. This puts the player in a position of particular mechanical and ocular advantage to more accurately contact the ball 46 at the sweet spot 56 of the striking face 22. It also puts the player in a position of particular mechanical and ocular advantage to detect whether he or she is opening 50 or closing 52 the striking face 22 during contact with the golf ball 46.

In a preferred embodiment, the present invention also provides a club head 16 with a sloped sole surface 24 as shown in FIG. 1. The from length 36 of the club head 16 is greater than the rear length 37 of the club head 16. A club head with a shorter rear length 37 and a longer front length 36, enables the player to use the proper shallow pendulum swing 58 when striking the ball without inadvertently striking the surface of the putting green and causing a mis-hit during the back swing or later upswing.

Figure 4:
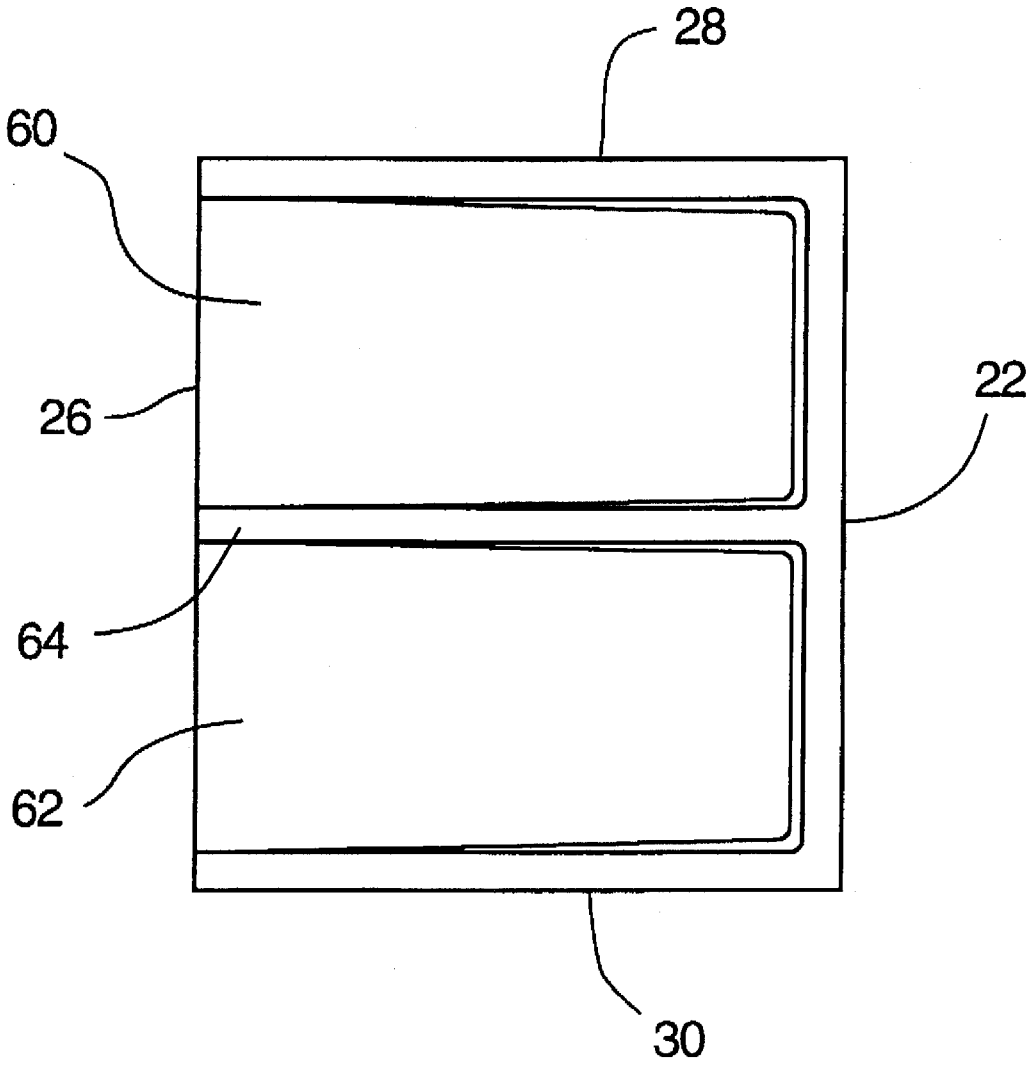
FIG. 4 is a bottom plan view of the club head.

As seen in FIG. 4, in a preferred embodiment, the sole surface 24 will have two substantially parallel cavities (a toe end cavity 60 and a heel end cavity 62) and a center strut 64 so as to lighten the weight of the club head while maintaining the strength of the club head 16 in its center of gravity.

In one of the presently preferred embodiments, the neck-soleline distance 76 (shown in FIG. 1) extending from the upper-end 70 of the neck 14 through the lower-end 72 of the neck 14 along the longitudinal axis of the neck 74 to the soleline 78 is less than or equal to 5.0 inches.

The present invention is not limited to the embodiments described above, but encompasses any and all embodiments within the scope of the claims. While the present invention has been described in detail by way of illustration and example for purposes of clarity, it is understood that certain changes and modifications may be made within the spirit of the invention and the scope of the appended claims.

What is claimed is:

1. A golf putter comprising:

(a) an elongated shaft having a hand grip end and a club head end;

(b) a club head having a top surface, a sole surface opposite to the top surface, a toe end, and a heel end parallel to the toe end, the top surface and the sole surface and the toe end and heel end defining a striking face and an opposite rear wall; and, (c) a neck coupling the club head end of the shaft to the top surface of the club head;

wherein the top surface of the club head forms a parallelogram having a breadth and a width, the breadth of the top surface being at least 3.0 inches, the breadth being less than or equal to the width; and further wherein the striking face depth is greater than the rear wall depth such that the sole surface of the club head is upwardly sloped from the striking face to the rear wall.

2. The golf putter of claim 1 wherein the longitudinal axis of the shaft is in the same plane as the striking face of the club head.

3. The golf putter of claim 2 wherein the relation between the longitudinal axis of the shaft and the longitudinal axis of the striking face is such that the longitudinal axis of the shaft is sub-perpendicular to longitudinal axis of the striking face.

4. The golf putter of claim 3 wherein the sub-perpendicular angular displacement of the longitudinal axis of the shaft in relation to the longitudinal axis of the striking face is about 20 degrees.

5. The golf putter of claim 1 wherein the sole surface of the club head having at least two cavities and a center strut, the at least two cavities being separated by the center strut, the center strut extending from the striking face of the club head to the rear wall of the club head.

6. The golf putter of claim 1 wherein the neck of the putter is coupled to the top surface of the club head in a position which is substantially equal in distance from the toe end and heel end of the club head.

7. A golf putter comprising:

(a) an elongated shaft having a hand grip end and a club head end;

(b) a club head having a top surface, a sole surface opposed to the top surface, a toe end, and a heel end opposed to the toe end, the top surface and the sole surface and the toe end and heel end defining a striking face and an opposite rear wall; and, (c) a neck coupling the club head end of the shaft to the top surface of the club head;

wherein the top surface of the club head forms a parallelogram having a breadth and a width, the breadth of the top surface being between 3.0 and 4.5 inches, the breadth being less than or equal to the width; and further wherein the shaft longitudinal axis is in the same vertical plane as the striking face of the club head; and, further wherein the striking face depth is greater than the rear wall depth such that the sole surface of the club head is upwardly sloped from the striking face to the rear wall.

8. The golf putter of claim 7 wherein the striking face of the club head has a longitudinal axis; and further wherein the relation between the shaft longitudinal axis and the striking face longitudinal axis is such that the shaft longitudinal axis is sub-perpendicular to the striking face longitudinal axis.

9. The golf putter of claim 8 wherein the angular displacement of the longitudinal axis of the shaft in relation to the longitudinal axis of the striking face being 20 degrees.

10. The golf putter of claim 7 wherein the sole surface of the club head having at least two cavities and a center strut, the at least two cavities being separated by the center strut, the center strut extending from the striking face of the club head to the rear wall of the club head.

11. The golf putter of claim 7 wherein the neck of the putter is coupled to the top surface of the club head in a position which is substantially equal distance from the toe end and heel end of the club head.

12. The golf putter of claim 1 or claim 7 wherein the neck of the club has a lower end and a upper end;

the lower end of the neck is positioned so as to be substantially equal in distance from the toe end and heel end of the club head; and the upper end of the neck is positioned so as to be between 0.5 and 1 inch closer to the heel end than to the toe end of the club head.

13. The golf putter of claim 1 or claim 7 wherein the intersection of the striking face edge and the toe end edge defines a 90 degree angle.

14. A golf putter comprising:

(a) an elongated shaft having a hand grip end and a club head end;

(b) a club head having a top surface, a sole surface opposed to the top surface, a toe end, and a heel end opposed to the toe end, the top surface and the sole surface and the toe end and heel end defining a striking face and an opposite a rear wall;

(c) a neck coupling the club head end of the shaft to the top surface of the club head; and, wherein the top surface of the club head forms a parallelogram having a breadth and a width, the breadth being at least 3.0 inches; further wherein the intersection of the striking face edge and the toe end edge defines a 90 degree angle;

further wherein the shaft longitudinal axis is in the same vertical plane as the striking face of the club head; and further wherein the striking face depth is greater than the rear wall depth such that the sole surface of the club head is upwardly sloped from the striking face to the rear wall.

* * * * *